US007413299B2

(12) United States Patent
Reeves

(10) Patent No.: US 7,413,299 B2
(45) Date of Patent: Aug. 19, 2008

(54) PRESSURIZING A HEATABLE PRINTHEAD WHILE IT COOLS

(75) Inventor: David D. Reeves, Dundee, OR (US)

(73) Assignee: Xerox Corporation, Norwalk, CT (US)

( * ) Notice: Subject to any disclaimer, the term of this patent is extended or adjusted under 35 U.S.C. 154(b) by 438 days.

(21) Appl. No.: 11/081,136

(22) Filed: Mar. 15, 2005

(65) Prior Publication Data

US 2006/0209146 A1 Sep. 21, 2006

(51) Int. Cl.
*B41J 2/175* (2006.01)

(52) U.S. Cl. ..... 347/88; 347/22; 347/25; 347/17

(58) Field of Classification Search ..... 347/22, 347/23, 25, 28, 29, 31, 46, 99, 17, 88
See application file for complete search history.

(56) References Cited

U.S. PATENT DOCUMENTS 5,910,810 A * 6/1999 Brooks et al. ..... 347/88
6,350,012 B1 2/2002 Sarkissian et al. ..... 347/46

OTHER PUBLICATIONS

Edward F. Burress, et al., Pressure Pump Systems , U.S. Appl. No. 10/753,045, filed Jan. 7, 2004.
Rodney B. Hill, et al., Purgeable Print Head Reservoir, U.S. Appl. No. 10/752,950, filed Jan. 7, 2004.

* cited by examiner

*Primary Examiner*—Juanita D Stephens
(74) *Attorney, Agent, or Firm*—Manuel Quiogue

(57) ABSTRACT

A method of operating a drop generating printhead including heating the printhead, providing melted phase change ink to the printhead, allowing the printhead to cool, and while the printhead is cooling, pressurizing the phase change ink in the printhead with a pressure that is sufficient to substantially maintain meniscuses at the outlets of the nozzles of the printhead as the phase change ink in the printhead solidifies. Also disclosed is a method of operating a drop generating printhead including heating the printhead, and pressurizing solidified phase change ink in the printhead with a pressure that is sufficient to substantially maintain meniscuses at the outlets of the nozzles of the printhead as the phase change ink in the printhead melts.

4 Claims, 5 Drawing Sheets

PRESSURIZING A HEATABLE PRINTHEAD WHILE IT COOLS

BACKGROUND OF THE DISCLOSURE

The subject disclosure is generally directed to ink jet printing, and more particularly to ink jet printing apparatus that includes an ink supply cable having a plurality of ink channels and an air channel.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid or phase change ink.

DETAILED DESCRIPTION OF THE DISCLOSURE

Figure 1:
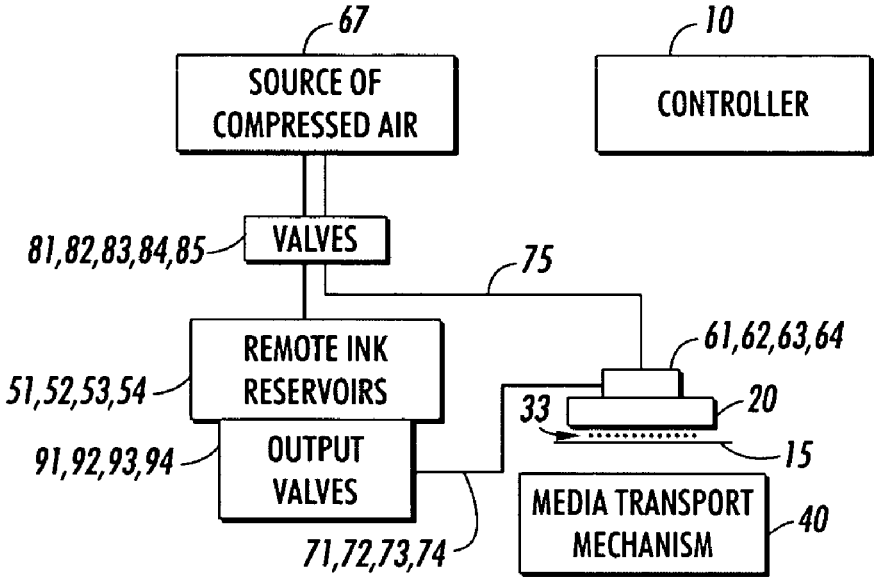
FIG. 1 is a schematic block diagram of an embodiment of an ink jet printing apparatus that includes remote ink reservoirs.
Figure 3:
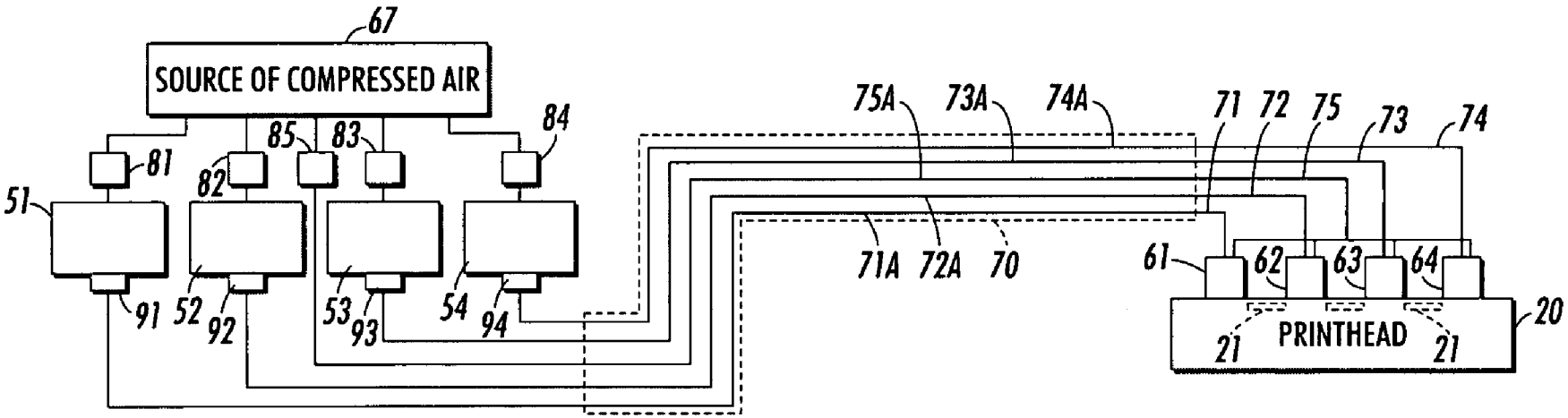
FIG. 3 is a schematic block diagram of an embodiment of ink delivery components of the ink jet printing apparatus of FIGS. 1 and 2.

FIGS. 1 and 3 are schematic block diagrams of an embodiment of an ink jet printing apparatus that includes a controller 10 and a printhead 20 that can include a plurality of drop emitting drop generators for emitting drops of ink 33 onto a print output medium 15. A print output medium transport mechanism 40 can move the print output medium relative to the printhead 20. The printhead 20 receives ink from a plurality of on-board ink reservoirs 61, 62, 63, 64 which are attached to the printhead 20. The on-board ink reservoirs 61-64 respectively receive ink from a plurality of remote ink containers 51, 52, 53, 54 via respective ink supply channels 71, 72, 73, 74. The remote ink containers 51-54 can be selectively pressurized, for example by compressed air that is provided by a source of compressed air 67 via a plurality of valves 81, 82, 83, 84. The flow of ink from the remote containers 51-54 to the on-board reservoirs 61-64 can be under pressure or by gravity, for example. Output valves 91, 92, 93, 94 can be provided to control the flow of ink to the on-board ink reservoirs 61-64.

The on-board ink reservoirs 61-64 can also be selectively pressurized, for example by selectively pressurizing the remote ink containers 51-54 and pressurizing an air channel 75 via a valve 85. Alternatively, the ink supply channels 71-74 can be closed, for example by closing the output valves 91-94, and the air channel 75 can be pressurized. As another alternative, suitable valving can be provided at the on-board reservoirs to allow for pressurization of the on-board reservoirs. Pressurizing the on-board ink reservoirs pressurized the interior of the printhead, which causes ink contained in the printhead to be pressurized. The on-board ink reservoirs 61-64 can be pressurized to perform a cleaning or purging operation on the printhead 20, for example. As described further herein, pressurizing the on-board reservoirs with a relatively low pressure during cool down or warm up can prevent contaminants from being drawn into the printhead. The printhead 20, the on-board ink reservoirs 61-64 and the remote ink containers 51-54 can be configured to contain melted solid or phase change ink and can be heated, for example by heater structures disposed in or on the printhead, the on-board ink reservoirs and the remote ink containers. The ink supply channels 71-74 and the air channel 75 can also be heated.

The on-board ink reservoirs 61-64 are vented to atmosphere during normal printing operation, for example by controlling the valve 85 to vent the air channel 75 to atmosphere. The on-board ink reservoirs 61-64 can also be vented to atmosphere during non-pressurizing transfer of ink from the remote ink containers 51-54 (i.e., when ink is transferred without pressurizing the on-board ink reservoirs 61-64).

Figure 2:
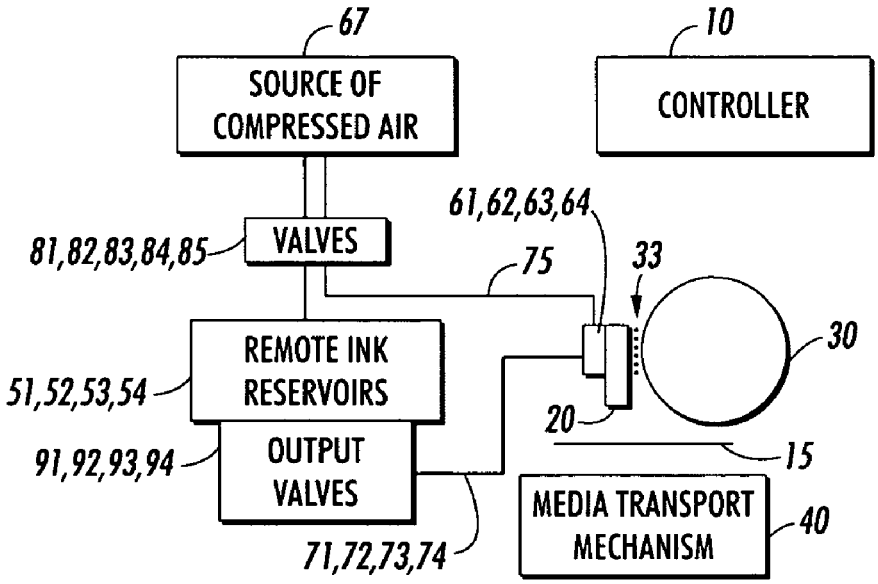
FIG. 2 is a schematic block diagram of another embodiment of an ink jet printing apparatus that includes remote ink reservoirs.

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 rollingly engages an output print medium 15 against the transfer drum 30 to cause the image printed on the transfer drum to be transferred to the print output medium 15.

As schematically depicted in FIG. 3, a portion of the ink supply channels 71-74 and the air channel 75 can be implemented as conduits 71A, 72A, 73A, 74A, 75A in a multi-conduit cable 70. As also schematically depicted in FIG. 3, the printhead 20 can include temperature sensors 21 for sensing the temperature of the printhead, for example at different locations. The temperature sensors 21 can provide temperature indicating signals to the controller 10, and can be implemented by thermistors, for example.

Figure 4:
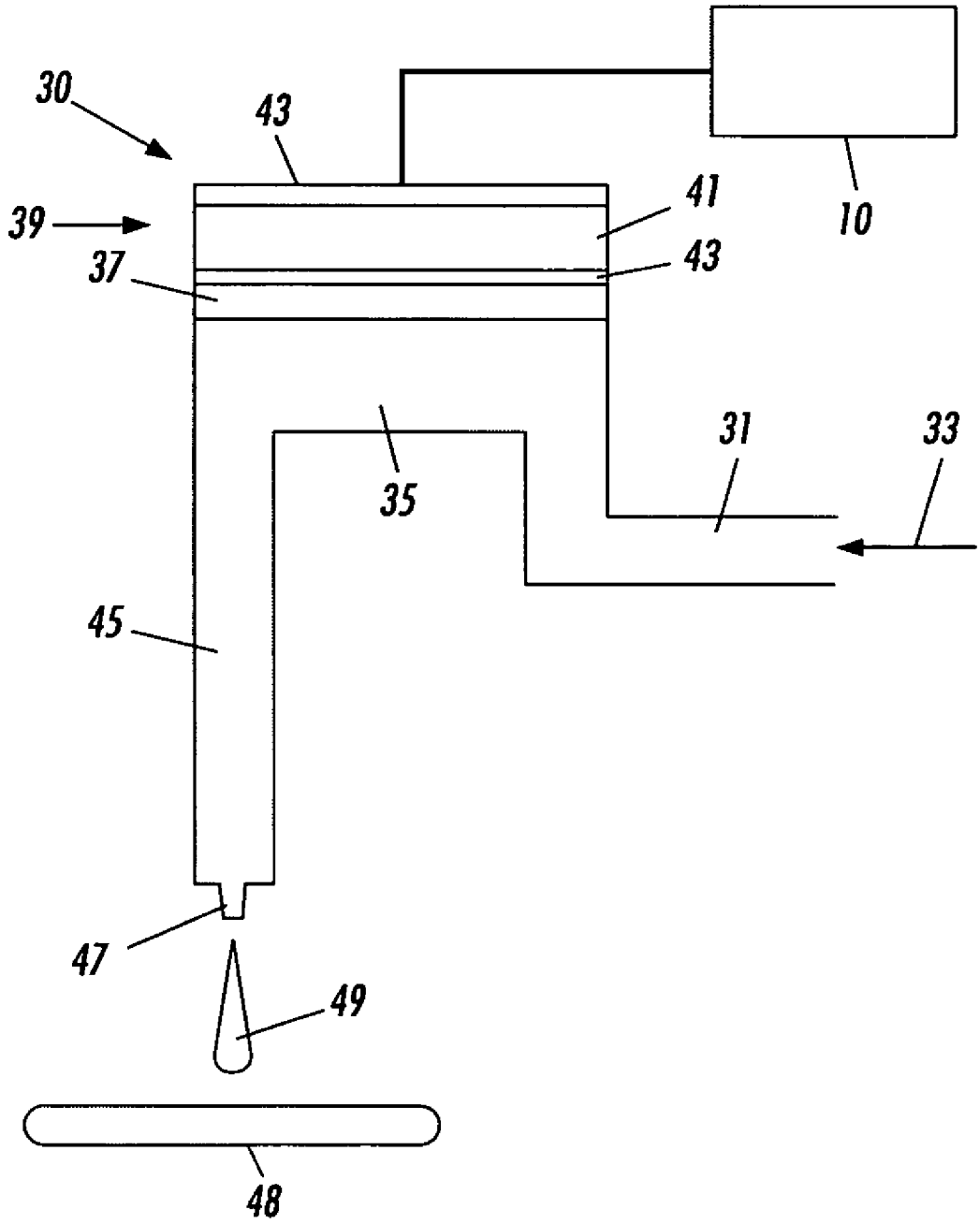
FIG. 4 is a schematic block diagram of an embodiment of a drop generator that can be employed in the printhead of the ink jet printing apparatus of FIG. 1 and in the printhead of the ink jet printing apparatus of FIG. 2.

FIG. 4 is a schematic block diagram of an embodiment of a drop generator 30 that can be employed in the printhead 20 of the printing apparatus shown in FIG. 1 and the printing apparatus shown in FIG. 2. The drop generator 30 includes an inlet channel 31 that receives melted phase change or solid ink 33 from a manifold, reservoir or other ink containing structure. The melted ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface or a print output medium, for example. The outlet channel 45 can include a nozzle or orifice 47. The end of the nozzle or orifice comprises an outlet of the nozzle or orifice.

Figure 5:
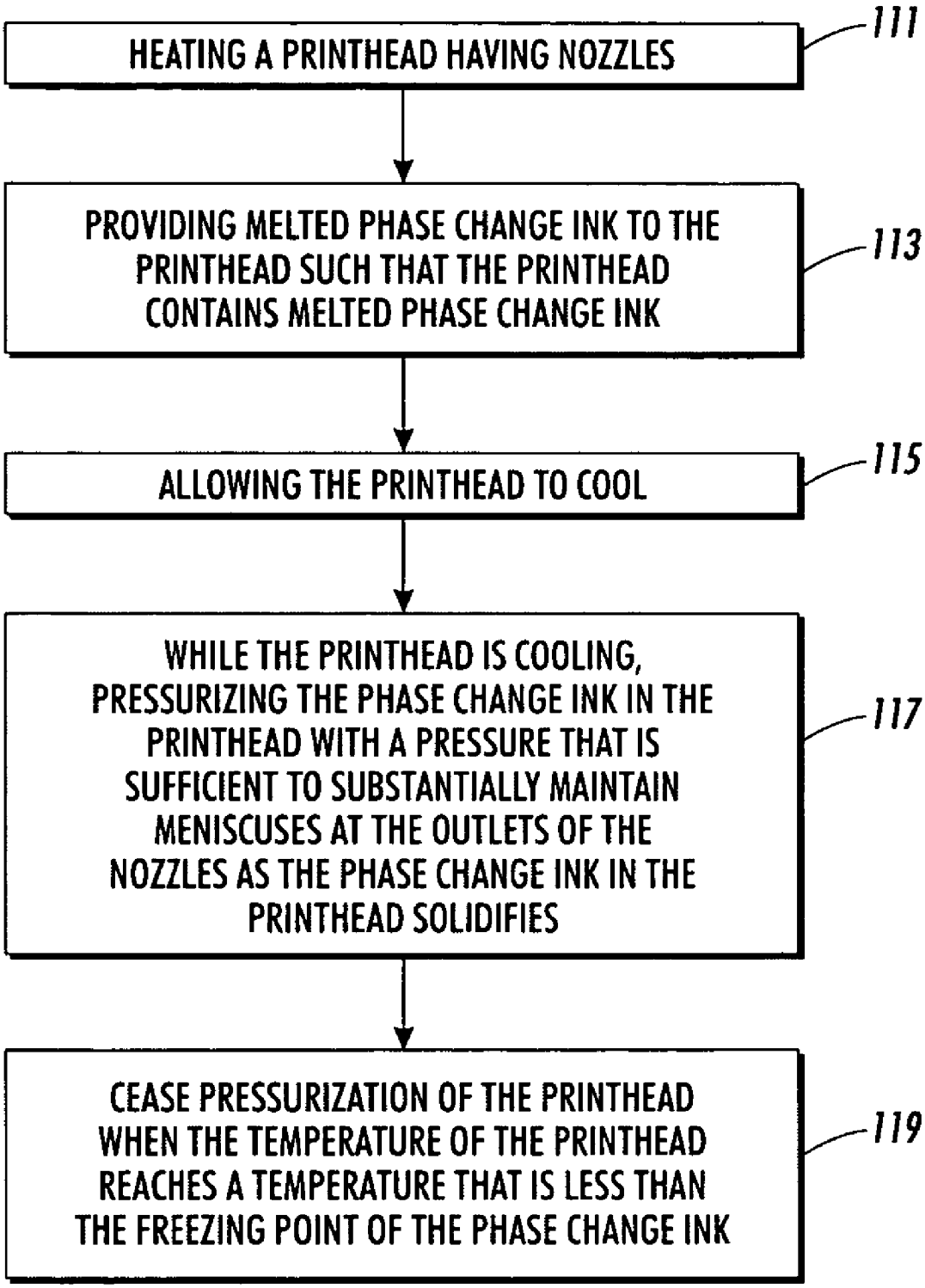
FIG. 5 is a flow diagram of an embodiment of a procedure for operating a printhead having nozzles.

FIG. 5 is a schematic flow diagram of a procedure for operating a printhead that includes nozzles. At 111 the printhead is heated, for example to a temperature of at least about the melting point the melted phase change ink that will be provided to the printhead at 113. This can be accomplished, for example, by energizing a heater structure disposed in or on the printhead. At 113 melted solid or phase change ink is provided to the printhead such that the printhead contains melted phase change ink. At 115 the printhead is allowed to cool, for example by removing power from the heater structure disposed in or on the printhead. At 117, while the printhead is cooling, the phase change ink in the printhead is pressurized with a relatively low pressure that is sufficient to substantially maintain meniscuses at the outlets of the nozzles of the printhead as the ink in the printhead solidifies, which substantially prevents ink in the nozzles from being withdrawn into the printhead as the phase change ink in the printhead solidifies. By way of illustrative example, the relatively low pressure can be in the range of about 1.2 inches of water to about 1.4 inches of water (or about 0.043 psi to about 0.050 psi). As another example, the relatively low pressure can be in the range of about 1.1 inches of water to about 1.5 inches of water (or about 0.040 psi to about 0.054 psi). At 119 pressurization is ceased when the printhead cools to a temperature that is less than the freezing point of the phase change ink. For example, pressurization can be ceased when the temperature of the printhead drops to a temperature that is about 5 to 10 degrees C. less than the freezing point of the phase change ink. Using a relatively low pressure to maintain a meniscus at the outlet of a nozzle can prevent contamination from being drawn into the nozzle as the ink in the printhead solidifies.

Figure 6:
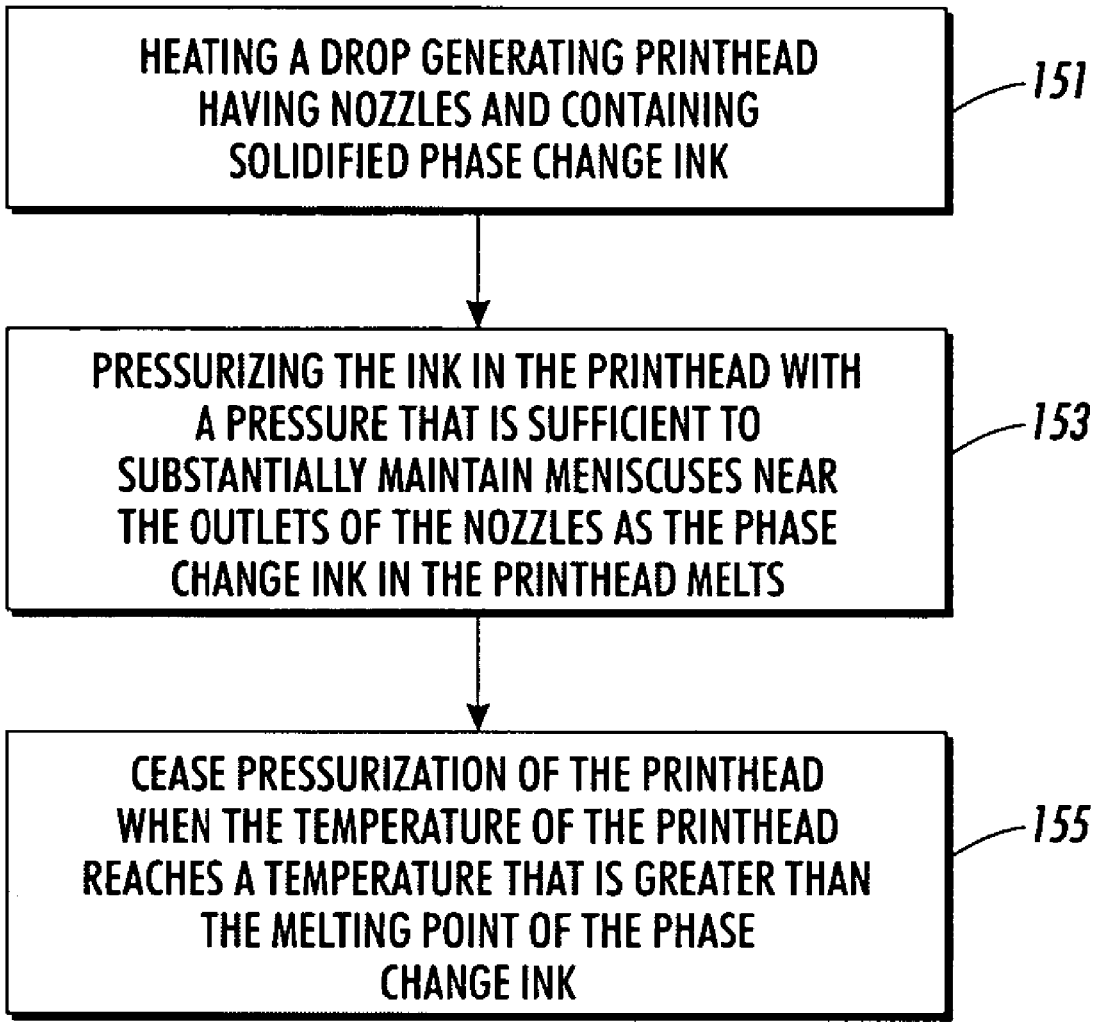
FIG. 6 is a flow diagram of an embodiment of a procedure for operating a printhead having nozzles and containing solidified phase change or solid ink.

FIG. 6 is a flow diagram of an embodiment of a procedure for operating a printhead having nozzles and containing solidified phase change or solid ink. At 151 the printhead is heated, for example to a temperature that is greater than the melting point of the phase change ink. At 153 the ink in the printhead is pressurized with a relatively low pressure that is sufficient to substantially maintain meniscuses in the outlets of the nozzles of the printhead as the phase change ink in the printhead melts, which substantially prevents ink in the nozzles from being withdrawn into the printhead as the phase change ink in the printhead melts. By way of illustrative example, the relatively low pressure can be in the range of about 1.2 inches of water to about 1.4 inches of water (or about 0.043 psi to about 0.050 psi). As another example, the relatively low pressure can be in the range of about 1.1 inches of water to about 1.5 inches of water (or about 0.040 psi to about 0.054 psi). At 155 pressurization is ceased when the printhead temperature reaches a temperature that is greater than the melting point of the phase change ink. For example, pressurization can be ceased when the temperature of the printhead reaches a temperature that is about 5 to 25 degrees C. greater than the melting point of the phase change ink. As another example, pressurization can be ceased when the temperature of the printhead reaches a temperature that is greater than the melting point of the phase change ink and about 5 to 15 degrees C. less than a predetermined temperature set point for the printhead. Using a relatively low pressure to maintain a meniscus at the outlet of a nozzle can prevent contamination from being drawn into the nozzle as the ink in the printhead melts.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating a drop generating printhead having nozzles, comprising:

heating the printhead;

providing melted phase change ink to the printhead such that the printhead contains melted phase change ink;

allowing the printhead to cool;

while the printhead is cooling, pressurizing the phase change ink in the printhead with a pressure that is sufficient to substantially maintain meniscuses at the outlets of the nozzles as the phase change ink in the printhead solidifies.

2. The method of claim 1 wherein pressurizing the phase change ink in the printhead comprises pressurizing the phase change ink in the printhead with a pressure of about 1.1 inches of water to about 1.5 inches of water.

3. The method of claim 1 further including:

ceasing pressurizing the phase change ink in the printhead when the temperature of the printhead cools to a temperature that is less than the freezing point of the phase change ink in the printhead.

4. The method of claim 1 further including ceasing pressurizing the phase change ink in the printhead when the temperature of the printhead cools to a temperature that is about 5 to 10 degrees C. less than the freezing point of the phase change ink in the printhead.

* * * * *